US005718656A

United States Patent [19]

Byrd et al.

[11] Patent Number: 5,718,656

[45] Date of Patent: Feb. 17, 1998

[54] EXERCISE PLATFORM HAVING UPPER BODY EXERCISING APPARATUS

[75] Inventors: Michael R. Byrd; Robert W. McBride, both of Springfield, Mo.

[73] Assignee: Stamina Products, Inc., Springfield, Mo.

[21] Appl. No.: 710,646

[22] Filed: Sep. 18, 1996

[51] Int. Cl.[6] ..... A63B 22/004; A63B 21/012; A63B 21/00

[52] U.S. Cl. ..... 482/53; 482/114; 482/138

[58] Field of Search ..... 482/70, 71, 91, 482/111, 114, 52, 112, 113, 146, 147, 51, 62, 908

[56] References Cited

U.S. PATENT DOCUMENTS

| | | | |
|---|---|---|---|
| 4,832,335 | 5/1989 | Tong | 482/112 |
| 4,869,496 | 9/1989 | Colombo | 482/71 |
| 5,346,451 | 9/1994 | Miller . | |
| 5,518,476 | 5/1996 | McLeon . | |
| 5,533,950 | 7/1996 | Lochbaum | 482/51 |

FOREIGN PATENT DOCUMENTS

| | | | |
|---|---|---|---|
| 617163 | 2/1927 | France | 482/117 |
| 2147212 | 5/1985 | United Kingdom | 482/117 |

*Primary Examiner*—Richard J. Apley
*Assistant Examiner*—Denise Pothier
*Attorney, Agent, or Firm*—Cushman Darby & Cushman IP Group of Pillsbury Madison & Sutro LLP

[57] ABSTRACT

An exercise apparatus including a base structure comprising a fixed lower body exercise platform and a pair of elongated upper body exercising units is disclosed. The units are mounted to the base structure by mounting structure that enables the units to be moved by a user against a yielding resistance in any direction with respect to a center in conjunction with the user stepping onto or off of the platform in any direction while performing an exercise thereon. The elongated upper body exercising units preferably include two telescoping exercise poles to be grasped by opposite hands of the user and capable of both oscillating and reciprocating upper body exercising motion. A variable volume air chamber is defined in an annular gap between coaxially arranged inner and outer members of the telescoping exercise poles and a restricted air passage communicates with the air chamber. Reciprocating motion of the telescoping pole causes the volume of the air chamber to alternately expand and contract and the restricted air passage restricts air flow into and out of the chamber to effect a resistance to the reciprocating motion. The poles are preferably mounted to the base structure by coupling each pole to a separate pivoting arm that is secured to the base structure so as to be pivotable about a vertical axis. Lateral orientation of the poles with respect to the base structure and each other can be varied by pivoting each pivoting arm to which each pole is attached and then securing each arm in a desired orientation.

13 Claims, 4 Drawing Sheets

EXERCISE PLATFORM HAVING UPPER BODY EXERCISING APPARATUS

BACKGROUND OF THE INVENTION

1. Field of the Invention

The present invention relates generally to an exercise apparatus comprising a fixed lower body exercise platform and a pair of pole-like exercising units operatively coupled with the exercise platform for movement by the user against a yielding resistance in any direction in conjunction with a lower body stepping exercise on the fixed lower body exercise platform to accommodate a wide range of motion of a user of the platform with respect to the platform.

2. Background Information

Step aerobics has become an increasingly popular mode of aerobic exercise. A small platform, or step, typically only few inches off the ground, is provided and the user performs the aerobic exercise with the assistance of the platform. Basically, the user performs various exercises by stepping on to and off of the platform in fairly rapid succession.

Aerobic platforms in use today are contacted only by the feet of the user. Further, platforms today provide only aerobic exercise and provide no resistance exercise. To incorporate resistance training into a step aerobic routine, the platform user must use hand and/or ankle weights of some type. Heretofore, platforms included no handles or rails to assist the user in maintaining balance while performing exercise, and included no apparatus to provide the user with upper body, i.e., arms, shoulders, and chest, exercise.

The present invention is based upon the recognition of a need in the aerobic platform exerciser art to provide an aerobic platform exerciser which has the built-in capability of integrating resistance exercising to the basic aerobic exercising capability of such exercisers.

SUMMARY OF THE INVENTION

An object of the present invention is to fulfill the need expressed above. In accordance with the principles of the present invention this objective is achieved by providing an exercising apparatus which includes a base structure comprising a fixed lower body exercise platform constructed and arranged to permit a user to perform lower body exercises by stepping onto and off of the fixed lower body exercise platform in any of a plurality of different directions with respect to the fixed lower body exercise platform. A pair of elongated upper body exercising units are provided which have upper ends constructed and arranged to be grasped by opposite hands of the user. And a pair of mounting structures are provided which are constructed and arranged to mount lower ends of the pair of elongated upper body exercising units on the base structure to enable the upper ends of the pair of elongated upper body exercising units to be moved by the user grasping the upper ends of the pair of elongated upper body exercising units and moving the pair of elongated upper body exercise units against a yielding resistance in any direction about centers generally coincident with respective lower ends of the pair of elongated upper body exercising units to accommodate movement of the user in different directions with respect to the fixed lower body exercise platform.

The mounting structure is constructed and arranged to enable the user to move one or both of the elongated upper body exercising units against the yielding resistance in conjunction with the user stepping onto or off of the fixed lower body exercise platform or while the user is standing on the fixed lower body exercise platform.

It has also been noted that a number of exercises to be performed in conjunction with a step aerobic platform have been developed which require that the user move in a wide range of directions with respect to the platform, i.e., from side to side, fore and aft, and diagonally across the platform. In accordance with the principles of the present invention, the accommodation of a wide range of movements is accomplished by providing the exercising apparatus describe above wherein the mounting structures include adjusting mechanisms constructed and arranged to enable adjustment of a lateral orientation of the centers associated with the pair of elongated upper body exercising units with respect to the base structure by pivoting the centers associated with the pair of elongated upper body exercising units about respective substantially parallel vertical axes into different operative positions in which the centers associated with the pair of upper body exercising units are disposed in different laterally spaced orientations with respect to the base structure to accommodate different movements of the user with respect to the fixed lower body exercise platform while the user is moving one or both elongated upper body exercising units in any direction against the yielding resistance about the associated centers in conjunction with the user stepping onto or off of the fixed lower body exercise platform or while the user is standing on the fixed lower body exercise platform.

These and other features of the present invention will become more apparent during the course of the following detailed description and appended claims. The invention may best be understood with reference to the accompanying drawings wherein an illustrative embodiment is shown.

DETAILED DESCRIPTION OF THE INVENTION

Figure 1:
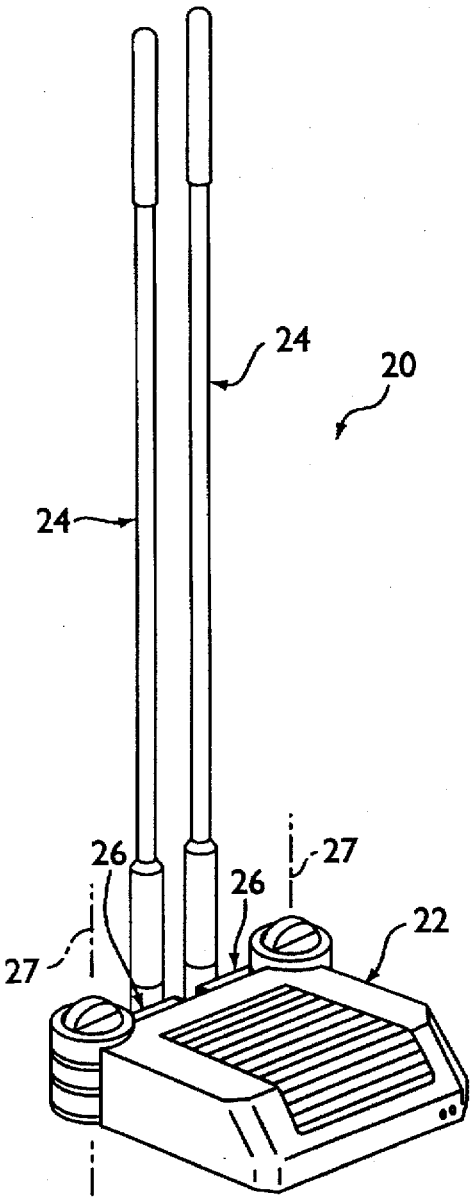
FIG. 1 is a perspective view of a step aerobic platform having upper body exercisers according to the present invention mounted thereon, with the upper body exercisers configured in a closely-spaced orientation.
Figure 2:
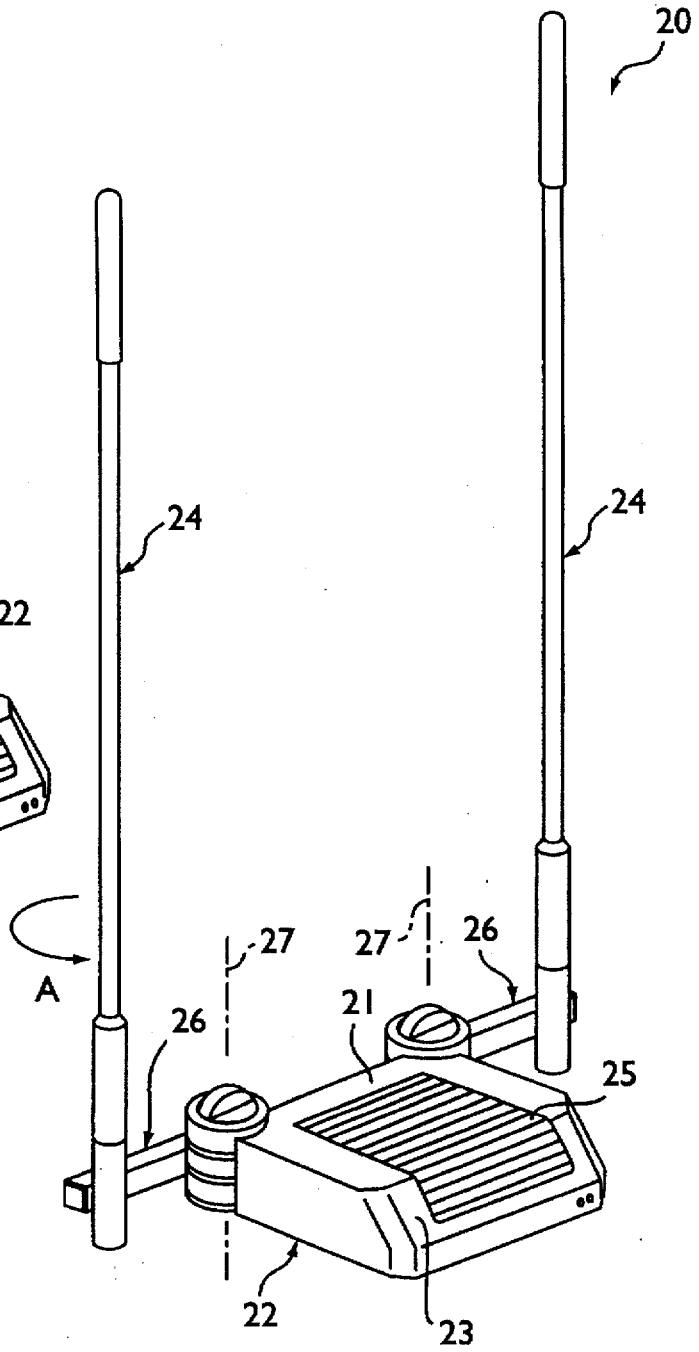
FIG. 2 is a perspective view of a step aerobic platform having upper body exercisers according to the present invention mounted thereon, with the upper body exercising units configured in a widely-spaced orientation.

An exercise apparatus 20 having upper body exercising units mounted thereon according to the principles of the present invention is shown in FIGS. 1 and 2. In the illustrated embodiment, the upper body exercising units, which comprise exercising poles 24 and pivoting mounting mechanisms 26, are attached to a step aerobic platform 22. Each of the mounting mechanisms 26 is preferably constructed, in a manner to be described below, so as to be pivotable in the direction indicated by arrow A in FIG. 2 about a substantially vertical pivot axis 27. As can be seen in FIGS. 1 and 2, the pivot axes 27 for both the left and right mounting mechanisms are substantially parallel to one another.

As shown by a comparison of FIGS. 1 and 2, the pivotability of mounting mechanisms 26 permits adjustment of the exercise poles 24 into a position, as shown in FIG. 1, of close proximity to one another or a configuration, as shown in FIG. 2, wherein poles 24 are widely spaced from one another and from the exercise platform 22. It can be appreciated that with the apparatus configured as shown in FIG. 1, a user can perform lateral side-to-side movements with respect to the platform 22, without impediment from the poles 24, and the user can grasp and use one or both poles 24 for upper body exercise and/or balance while making the side-to-side movements. Similarly, with the apparatus configured as shown in FIG. 2, a user can perform fore-and-aft movements with respect to the platform 22, without impediment from the poles 24, and the user can grasp and use one or both poles 24 for upper body exercise and/or balance while making the fore-and-aft movements. Furthermore, exercise poles 24 can preferably be adjusted into any position between that shown in FIG. 1 and that shown in FIG. 2, and the adjusting mechanisms can be pivoted rearwardly so that the exercise poles 24 are disposed against the sides of the platform 22.

In the preferred embodiment of the present invention, platform 22 comprises a conventional step aerobic platform, preferably including a flat top surface 21, an angled surface 23 extending downwardly from the flat top surface 21, and an area 25, including portions of top surface 21 and angled surface 23, having laterally extending ridges, or the like, provided thereon to enhance traction on the platform.

Although the upper body exercising units of the present invention are illustrated and described with respect to mounting thereof on a step aerobic platform, it is to be understood that, in the broadest aspects contemplated of the present invention, the upper body exercising units described herein could as well be mounted on various other types of lower body exercising platforms, such as, for example, treadmills, stationary bicycles, cross-country ski machines, and stair stepping machines. The moveability of the upper body exercise units of the present invention is most beneficial when the units are incorporated with a lower body exercise device that permits or requires a wide range of motion by the user with respect to the device, such as a step aerobic platform.

Furthermore, although it is preferred that the poles be mounted to the platform so as to be laterally pivotable, in the broadest aspects contemplated of the invention, significant benefit and improvement over prior art exercise platforms can be realized by providing an exercise platform with exercise poles having no pivoting adjusting capability.

The construction and assembly of the exercise poles 24 and mounting mechanisms 26 will be described in further detail with reference to FIGS. 3–7.

Figure 3:
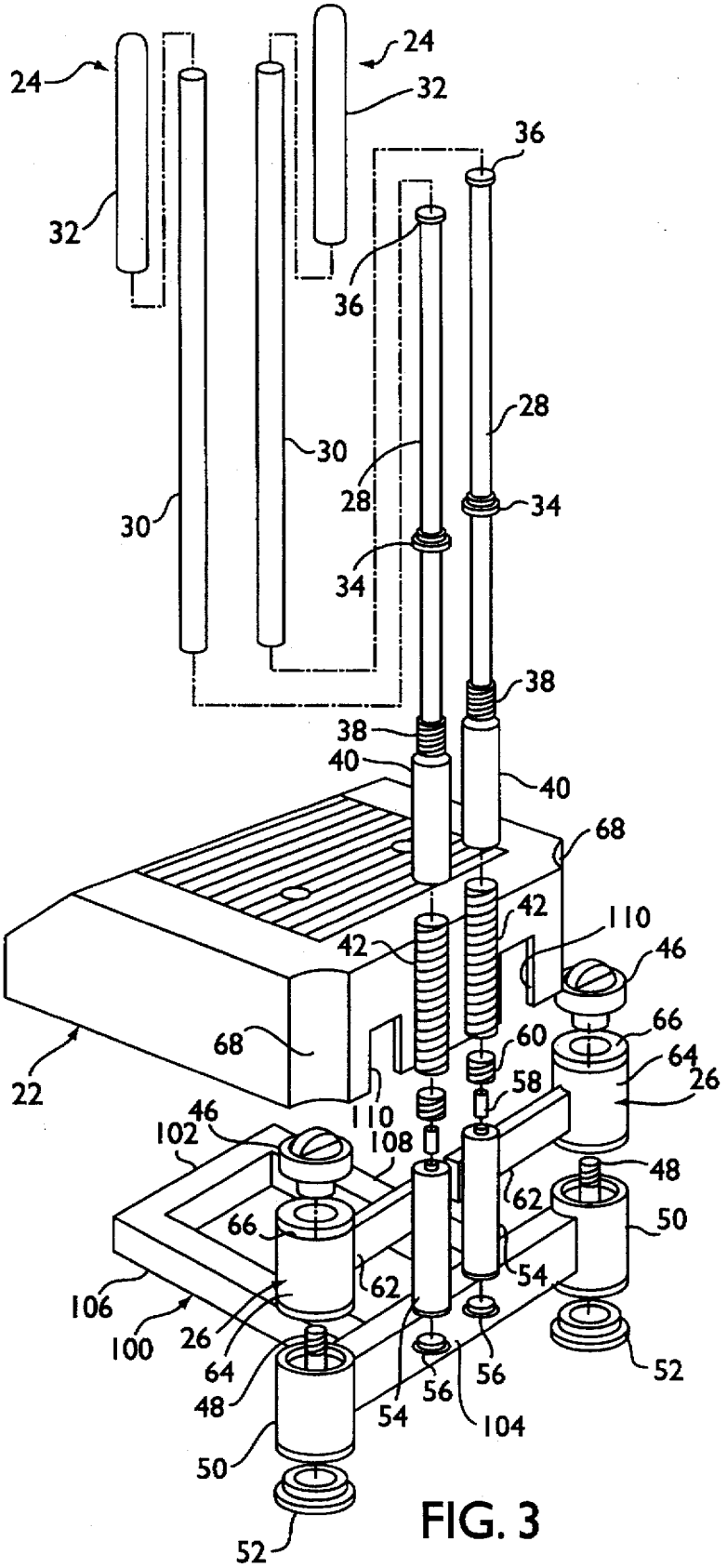
FIG. 3 is an exploded perspective view of the upper body exercising apparatus of the present invention as mounted on a step aerobic platform.

As shown in FIG. 3, each exercise pole 24 comprises an inner elongated member, or tube, 28 preferably of hollow tubular construction, and an outer elongated member, or tube, 30 preferably of a hollow tubular construction that is sized so as to fit coaxially over the inner elongated member 28 with a gap 29 (see FIGS. 5 and 6) between an outer surface of inner elongated member 28 and an inner surface of outer elongated member 30. Inner elongated member 28 is preferably made of aluminum and outer elongated member 30 is preferably made of polyvinylchloride ("PVC").

Figure 4:
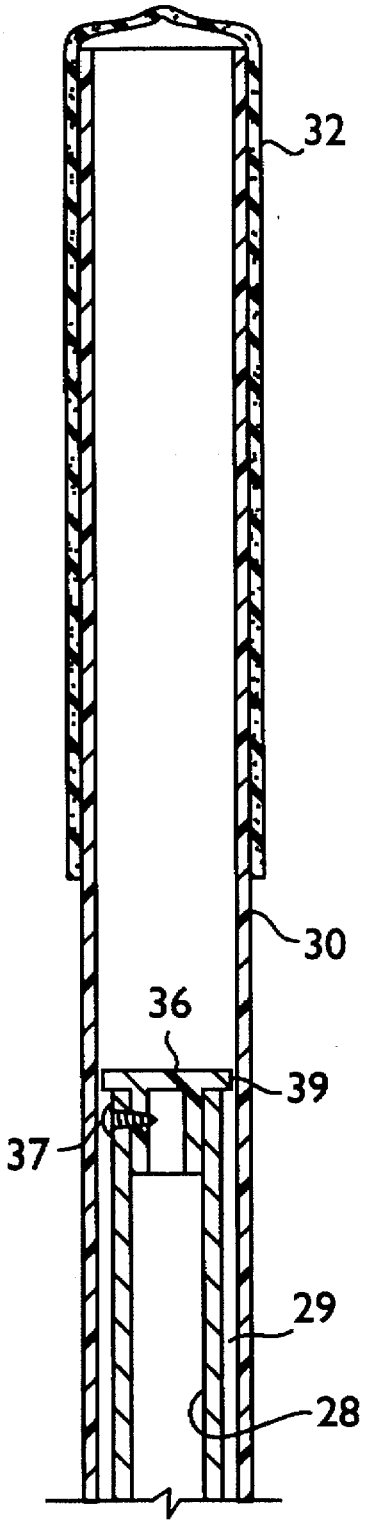
FIG. 4 is a partial cross-sectional view of an upper portion of an exercise pole of an upper body exerciser according to the present invention.
Figure 5:
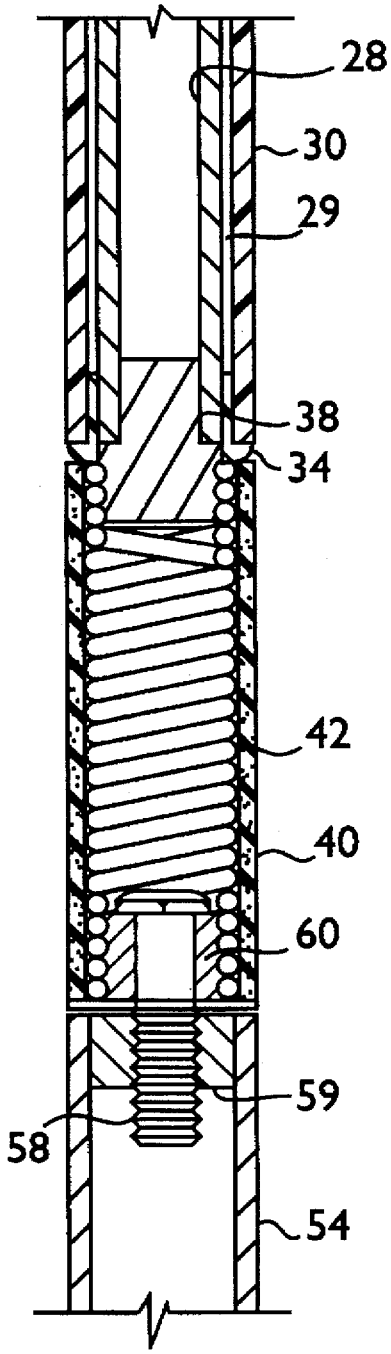
FIG. 5 is a partial cross-sectional view of a lower portion of an exercise pole of an upper body exerciser according to the present invention.

As shown in FIGS. 3–5, exercise poles 24 include coupling structure for operatively coupling the inner and outer elongated members 28 and 30. This coupling structure includes a guide plug 36 and an annular bushing 34. Guide plug 36 is disc-shaped and is disposed at the top end of the inner elongated member 28 and includes a cylindrical portion that fits inside inner tube 28 and is preferably held in place by a set screw 37. (see FIG. 4) The outside diameter of the guide plug 36 is smaller than the inside diameter of the outer elongated member 30 so that the outer elongated member 30 can easily fit over guide plug 36 and so that an annular gap 39 is defined between the outer periphery of the guide plug 36 and the inner surface of the outer elongated member 30.

Bushing 34 is snugly but slidably disposed on the inner elongated member 28 at a position below the guide plug 36. The lower end of outer elongated member 30 is fixedly secured to the bushing 34, preferably by press-fitting bushing 34 into elongated member 30 or by providing mating exterior threads on the bushing 34 and interior threads on the lower end of the outer elongated member 30. Bushing 34 is preferably composed of plastic.

A foam grip 32 is preferably provided over the upper end of the outer elongated member 30.

With the inner elongated member 28 and outer elongated member 30 configured as described, it can be appreciated that outer elongated member 30 is able to move in an axial telescoping manner with respect to the inner elongated member 28. Guide plug 36 functions as a stop which prevents the outer elongated member 30 from being raised beyond the upper end of the inner elongated member 28 when bushing 34 contacts guide plug 36. Thus telescoping movement of outer elongated member 30 with respect to inner elongated member 28 is limited by guide plug 36.

Furthermore, guide plug 36 and bushing 34 define a variable volume air chamber within gap 29. The volume of the air chamber is greatest when outer tube 30 is at its lowest position with respect to inner tube 28, i.e., when bushing 34 is at its most spaced apart position from guide plug 36. Alternatively, the volume of the air chamber is smallest, i.e., zero, when the outer tube 30 is at its highest position with respect to inner tube 28, i.e., when bushing 34 comes into contact with guide plug 36.

When outer tube 30 is raised with respect to inner tube 28, the decreasing volume of the air chamber forces air out of the variable volume air chamber through annular gap 39, which functions as an air passage. Because of the small size of air passage 39, airflow therethrough is restricted. As mentioned above, bushing 34 preferably fits snugly over inner tube 28, and therefore, little if any air escapes from the variable volume air chamber through the interface of bushing 34 and inner tube 28. The restriction of the flow of air being forced out of the variable volume air chamber through air passage 39 effects a resistance to the rapid raising of the outer tube 30 with respect to the inner tube 28.

Similarly, when the outer tube 30 is lowered with respect to inner tube 28, the increasing volume of the air chamber draws air into the variable volume air chamber through the air passage 39. Again, the restriction of the flow of air being drawn into the variable volume air chamber through air passage 39 effects a resistance to the rapid lowering of the outer tube 30 with respect to the inner tube 28.

Resistance to rapid raising and lowering of the outer tubes 30 with respect to the inner tubes 28 enhances the aerobic exercise effect of rapid reciprocating movement of the exercise poles 24 by a user.

An insert 38 is attached to the lower end of the inner tube 28. Insert 38 is externally threaded so as to be threadable into the upper end of a coil spring 42. Insert 38 is preferably comprised of steel and is preferably secured to inner elongated member 28 by means of exterior threads that mate with interior threads formed in the lower end of inner tube 28. A sleeve 40, preferably comprised of foam, is preferably placed over coil spring 42 to cover and protect spring 42.

As shown in FIG. 3, a frame structure 100 is preferably disposed within the platform 22. Poles 24 are attached to frame 100 via mounting mechanisms 26 in a manner to be described in more detail below. Frame 100 includes two parallel, spaced apart longitudinal structural members 106 and 108 and a lateral structural member 102 extending therebetween. A second lateral structure member 104 extends across the ends of longitudinal structural members 106 and 108 and extends laterally beyond the width of the spaced longitudinal members 106 and 108. Structural members 102, 104, 106 and 108 are preferably composed of tubular steel and are preferably attached to one another by welding.

The structure 100 is secured beneath the platform 22. Slots 110 (see FIG. 3) provided in the end face of platform 22 accommodate longitudinal structural members 106 and 108. Structural frame 100 is preferably secured to platform 22 by mechanical fasteners, such as bolts or screws or the like.

Figure 7:
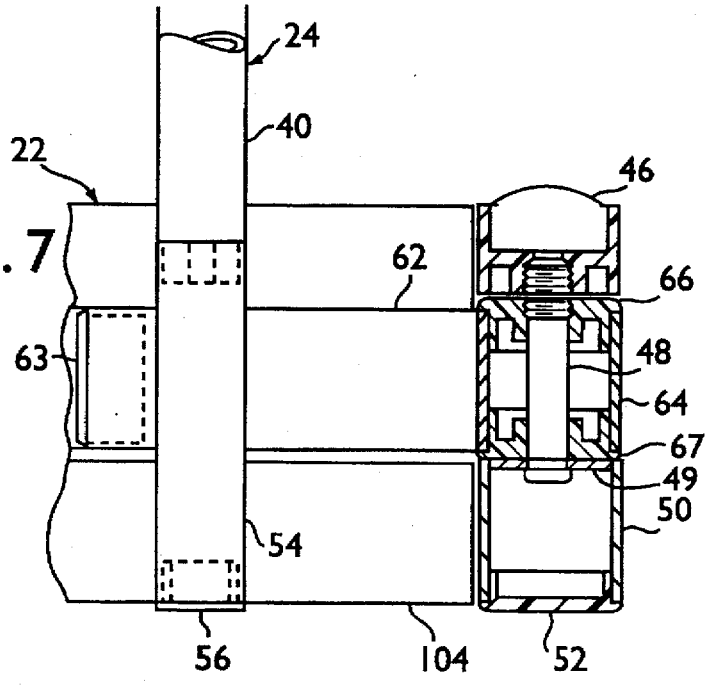
FIG. 7 is a partial elevation, partially in cross-section, of a step aerobic platform having upper body exercisers according to the present invention mounted thereon.

As shown in FIGS. 3 and 7, cylindrical swivel mounts 50 are disposed on opposite ends of the lateral structural member 104. Swivel mounts 50 are preferably of a steel tubular construction and are preferably secured to lateral structural member 104 by welding. Circular plastic plugs 52 are preferably inserted into the lower end of the cylindrical swivel mount 50 so as to prevent the lower end of swivel mount 50 from scratching or scuffing a floor surface. A threaded lug 48 extends vertically upwardly from the center of the cylindrical swivel mount 50. Lug 48 preferably comprises an upwardly extending bolt welded to a washer 49 which is welded to the swivel mount 50.

Figure 6:
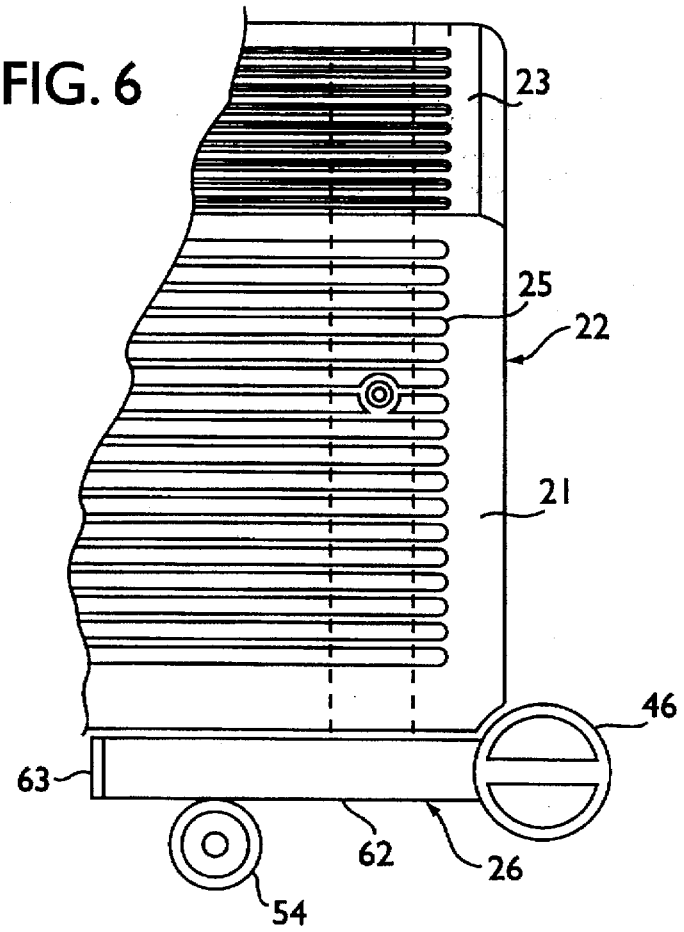
FIG. 6 is a partial plan view of a step aerobic platform having upper body exercisers according to the present invention mounted thereon.

Mounting mechanisms 26 are secured atop the cylindrical swivel mounts 50 so as to be pivotal with respect thereto. As shown in FIGS. 3, 6, and 7, each mounting mechanism 26 includes a cylindrical swivel guide 64, a pivoting arm 62, and a pole attachment tube 54, all preferably of tubular steel construction and secured to one another by welding. Pivoting arm 62 extends radially outwardly from the swivel guide 64, and pole attachment tube 54 is secured proximate an end of the pivoting arm 62 opposite from the swivel guide 64. Plastic caps 63 are preferably press-fitted into the ends of pivoting arm 62. Swivel guide 64 includes circular plugs 66 and 67 inserted into opposite axial ends thereof, each plug having a centrally located aperture extending therethrough for receiving the threaded lug 48 extending from the swivel mount 50. An adjusting knob 46 having an interiorly threaded bore, is threaded onto the upper end of the lug 48.

It can be appreciated that swivel guide 64 sits atop the swivel mount 50 and is able to rotate with respect thereto about the lug 48. Adjusting knob 46 can be tightened onto lug 48 so as to place the swivel guide 64 into a state of compression between the swivel mount 50 and the adjusting knob 46 to prevent pivoting of the mounting mechanism 26 and thus secure the mounting mechanism 26 in a desired orientation.

Swivel guide 64 could be secured in a desired orientation by other means as well. For example, a disc having circumferentially-spaced apertures could be provided above and/or below swivel guide 64. An aperture provided in pivoting arm 62 would permit pivoting arm 62 to be locked by placing a pin through aligned holes in pivoting arm 62 and the above described disc(s). The above-described adjusting knobs 46 are preferred, however, because they permit a continuous variety of pivoting arm orientations.

Arcuate surfaces 68 are preferably formed in the corners of the platform 22 so as to accommodate the cylindrical swivel mount 50 and the swivel guide 26.

The pole attachment tube 54 preferably extends downwardly below the pivoting arm 62 so that the bottom end of the pole attachment tube 54 is in contact with the floor at all times. Plastic caps 56 are preferably inserted into the bottom end of the pole attachment tube 54 so as to prevent scuffing or scratching of the floor surface.

As shown in FIGS. 3 and 5, annular threaded inserts 60 having an interiorly threaded aperture are secured to the tops of the pole attachment tubes 54 by means of bolts 58. Bolts 58 are threaded into threaded slugs 59, which are welded to attachment tubes 54. The outer surface of insert 60 is threaded so as to accommodate the lower end of coil spring 42. In this manner, poles 24 are operatively secured, or mounted, to the base structure via the mounting mechanisms 26 and are capable of oscillation, via the coil springs 42, in any direction about the points at which the springs 42 are attached to the base, i.e., at the top of pole attachment tubes 54, which comprise centers of movement of the poles 24. The coil springs 42 also provide yielding resistance to oscillating movement of the poles 24, thus enhancing the exercise effect of such movement. Of course, while a coil spring is preferred, it should be apparent that other resilient couplings, such as for example, lengths of rubber hose of sufficient stiffness, could be used to couple the lower ends of poles 24 to the mounting mechanisms is manner that permits oscillation of the poles in any direction.

Further, while in the preferred embodiment shown both the mounting function and the yieldable resistance providing function are performed by a single structure, namely, coil spring 42, it is within the contemplation of the invention in it broadest aspects to provide these functions by separate structures. One example might comprise a rigid mount fixing the pole to the base structure in a fixed, vertical orientation, with a coil spring provided at an intermediate location along the length of the pole to permit movement against yielding resistance about the intermediate point.

Furthermore, in embodiments having no lateral adjustment capability, the poles are operatively coupled, by means of springs or the like, directly to a fixed portion of the platform.

As mentioned above, the inner tubes 28 are preferably made of aluminum and the outer tubes 30 are preferably made of PVC. A user of the base lower body exercise device, especially a user of a step aerobic platform, can be expected to move through a wide range of positions and directions with respect to the base in the context of performing the lower body exercise thereon. Accordingly, it is desired that the exercise poles be able to accommodate this wide range of movement. Part of that accommodation is provided by the mounting of the poles to the platform which permits the poles to oscillate in any direction about their centers. In addition, the tubes, primarily the PVC outer tube 30 but also to some extent the aluminum inner tube 28, are able to flex elastically, thus further accommodating a wide range of movement by the user with respect to the base.

The embodiment describe above represents the preferred embodiment of the present upper body exercising apparatus.

As an alternative to the configuration described above, the outer hollow tube of the exercise poles could be coupled, via a coil spring, to a base exercise device and the inner tube could be disposed so as to be capable of telescoping movement with respect to the outer tube. In this case, a guide plug would be fixed to the bottom end of the inner tube and a slidable bushing would be fixed to an upper end of the outer tube.

Also alternatively, the guide plug could be dimensioned so as to fit snugly between the inner and outer tubes and a gap could be provided between the bushing and the outer surface of the inner tube, which would then serve as the restricted air passage.

In either of the above-described alternative embodiments, the fundamental operation of the present invention is the same. Specifically, as a telescoping tube is moved axially upwardly with respect to a fixed tube, the volume of a variable volume air chamber defined between the two coaxial tubes decreases, and air is forced out of the chamber through a restricted air passage which effects a resistance to the upward axial movement. Conversely, as the telescoping tube is moved axially downwardly with respect to the fixed tube, the volume of a variable volume air chamber increases, and air is drawn into the chamber through the restricted air passage which effects a resistance to the downward axial movement.

It will be realized that the foregoing preferred specific embodiment of the present invention has been shown and described for the purposes of illustrating the functional and instructional principles of this invention and are subject to change without departure from such principles. Therefore, this invention includes all modifications encompassed within the spirit and scope of the following claims.

What is claimed is:

1. An exercising apparatus comprising:

a base structure comprising a fixed lower body exercise platform, said lower body exercise platform presenting a fixed step-receiving surface consisting substantially of an entire upper surface of said lower body exercise platform, said lower body exercise platform being constructed and arranged to permit a user to perform lower body exercises by stepping onto and off of said step-receiving surface of said fixed lower body exercise platform in any of a plurality of different directions with respect to said fixed lower body exercise platform;

a pair of elongated upper body exercising units having upper ends constructed and arranged to be grasped by opposite hands of the user; and a pair of mounting structures constructed and arranged to mount lower ends of said pair of elongated upper body exercising units on said base structure, said mounting structures including laterally yielding members constructed and arranged to enable said upper ends of said pair of elongated upper body exercising units to be moved by the user grasping the upper ends of said pair of elongated upper body exercising units and moving said pair of elongated upper body exercise units in any direction about centers generally coincident with respective lower ends of said pair of elongated upper body exercising units to accommodate movement of the user in different directions with respect to said fixed lower body exercise platform, said laterally yielding members being further constructed and arranged to provide a yielding resistance to said movement by the user of said pair of elongated upper body exercising units in any direction about said centers, each of said laterally yielding members comprising a coil spring constructed and arranged to secure said lower end of an associated elongated upper body exercising unit to said base structure and to provide said yielding resistance to said movement of said associated elongated upper body exercising unit in any direction about said center, said mounting structure being constructed and arranged to enable the user to move one or both of said elongated upper body exercising units against said yielding resistance in conjunction with the user stepping onto or off of said step-receiving surface of said fixed lower body exercise platform or while the user is standing on said fixed lower body exercise platform.

2. The exercising apparatus of claim 1 wherein said mounting structures include adjusting mechanisms having pivoting structures, said adjusting mechanisms being constructed and arranged to enable adjustment of a lateral orientation of said centers with respect to said base structure by pivoting said centers on said pivoting structures about respective substantially parallel vertical axes into different operative positions in which said centers are disposed in different laterally spaced orientations with respect to said base structure to accommodate different movements of the user with respect to said fixed lower body exercise platform while the user is moving one or both elongated upper body exercising units in any direction against said yielding resistance about said centers in conjunction with the user stepping onto or off of said step-receiving platform of said fixed lower body exercise platform or while the user is standing on said step-receiving platform of said fixed lower body exercise platform.

3. The adjustable exercising apparatus of claim 2 wherein each of said adjusting mechanisms comprises:

a swivel mount, fixed to said base structure;

a threaded lug extending vertically upwardly from said swivel mount;

a cylindrical swivel guide having an aperture defined axially therethrough, said cylindrical swivel guide being dispose on said swivel mount with said threaded lug extending through said axial aperture to enable rotation of said cylindrical swivel guide about said threaded lug;

a pivoting arm extending radially outwardly from said cylindrical swivel guide and pivoting about said threaded lug when said cylindrical swivel guide is rotated about said threaded lug;

a pole attachment member fixed proximate an end of said pivoting arm opposite said cylindrical swivel guide constructed and arranged for attachment of said lower end of an associated elongated upper body exercising unit thereto, said center of said associated elongated upper body exercising unit being pivotable about said threaded lug with said pivoting arm and said pole attachment member; and an adjusting knob disposed atop said cylindrical swivel guide, said adjusting knob having a bore defined therein with interior threads for receiving an end portion of said threaded lug extending beyond said axial aperture defined in said cylindrical swivel guide, when said adjusting knob is tightened onto said end portion of said threaded lug, said cylindrical swivel guide is compressed between said adjusting knob and said swivel mount to prevent rotation of said cylindrical swivel guide about said threaded lug to fix said center of said associated elongated upper body exercising unit attached to said pole attachment member in a selected lateral orientation with respect to said base structure.

4. An exercising apparatus comprising:

a base structure comprising a fixed lower body exercise platform constructed and arranged to permit a user to perform lower body exercises by stepping onto and off of said fixed lower body exercise platform in any of a plurality of different directions with respect to said fixed lower body exercise platform;

a pair of elongated upper body exercising units having upper ends constructed and arranged to be grasped by opposite hands of the user; and a pair of mounting structures constructed and arranged to mount lower ends of said pair of elongated upper body exercising units on said base structure, said mounting structures including laterally yielding members constructed and arranged to enable said upper ends of said pair of elongated upper body exercising units to be moved by the user grasping the upper ends of said pair of elongated upper body exercising units and moving said pair of elongated upper body exercise units in any direction about centers generally coincident with respective lower ends of said pair of elongated upper body exercising units to accommodate movement of the user in different directions with respect to said fixed lower body exercise platform said laterally yielding members being further constructed and arranged to provide a yielding resistance to said movement by the user of said pair of elongated upper body exercising units in any direction about said centers, said mounting structure being constructed and arranged to enable the user to move one or both of said elongated upper body exercising units against the yielding resistance in conjunction with the user stepping onto or off of said fixed lower body exercise platform or while the user is standing on said fixed lower body exercise platform, said mounting structures including adjusting mechanisms having pivoting structures, said adjustment mechanisms constructed and arranged to enable adjustment of a lateral orientation of said centers with respect to said base structure by pivoting said centers about respective substantially parallel vertical axes on said pivoting structures into different operative positions in which said centers are disposed in different laterally spaced orientations with respect to said base structure to accommodate different movements of the user with respect to said fixed lower body exercise platform while the user is moving one or both elongated upper body exercising units in any direction against the yielding resistance about said centers in conjunction with the user stepping onto or off of said fixed lower body exercise platform or while the user is standing on said fixed lower body exercise platform.

5. The exercising apparatus of claim 4 wherein each of said elongated upper body exercising units comprises:

a fixed elongated member mounted at a lower end thereof to the base structure to enable said upper end of said elongated upper body exercising unit to be moved by the user grasping the upper end of said elongated upper body exercising unit and moving said elongated upper body exercising unit against said yielding resistance in any direction about said center generally coincident with said lower end of said elongated upper body exercising unit to accommodate movement of the user in different directions with respect to said fixed lower body exercise platform;

a telescoping elongated member oriented substantially coaxially with respect to said fixed elongated member; and elongated member coupling structure constructed and arranged to couple said fixed elongated member to said telescoping elongated member to enable limited telescoping axial movement of said telescoping elongated member with respect to said fixed elongated member, said telescoping elongated member moving axially upwardly with respect to said fixed elongated member to accommodate the user moving away from said fixed lower body exercise platform while the user is grasping the upper end of said elongated upper body exercising unit and moving said upper body exercising unit against said yielding resistance about said center in conjunction with the user stepping off of said step-receiving surface of said fixed lower body exercise platform, and said telescoping elongated member moving axially downwardly with respect to said fixed elongated member to accommodate the user moving toward said fixed lower body exercise platform while the user is grasping the upper end of said elongated upper body exercising unit and moving said elongated upper body exercising unit against said yielding resistance about said center in conjunction with the user stepping onto said step-receiving platform of said fixed lower body exercise platform.

6. The exercising apparatus of claim 5 wherein said fixed elongated member and said telescoping elongated member define a gap therebetween and said elongated member coupling structure is further constructed and arranged to:

(1) define a variable volume air chamber within said gap defined between said fixed elongated member and said telescoping elongated member, a volume of said variable volume air chamber expanding when said telescoping elongated member is moved by the user axially downwardly with respect to said fixed elongated member and the volume of said variable volume air chamber contracting when said telescoping elongated member is moved by the user axially upwardly with respect to said fixed elongated member, and (2) define a restricted air passage between a portion of said elongated member coupling structure and a one of said telescoping elongated member and said fixed elongated member, said restricted air passage being constructed and arranged to restrict air flow into said variable volume air chamber when the volume of said variable volume air chamber is expanding to effect a resistance to downward axial movement of said telescoping elongated member with respect to said fixed elongated member to enhance an exercising effect of downward axial movement of said telescoping elongated member with respect to said fixed elongated member by the user, and to restrict air flow out of said variable volume air chamber when the volume of said variable volume air chamber is contracting to effect a resistance to upward axial movement of said telescoping elongated member with respect to said fixed elongated member to enhance an exercising effect of upward axial movement of said telescoping elongated member with respect to said fixed elongated member by the user.

7. The exercising apparatus of claim 6 wherein said fixed elongated member comprises an inner elongated member operatively coupled at a lower end thereof with said base structure; said telescoping elongated member comprises an outer hollow elongated member fitting substantially coaxially over said inner elongated member and defining said gap between an outer surface of said inner elongated member and an inner surface of said outer hollow elongated member; and said elongated member coupling structure is constructed and arranged to:

(1) couple said inner elongated member to said outer hollow elongated member to enable limited telescoping axial movement of said outer hollow elongated member with respect to said inner elongated member, said outer hollow elongated member moving axially upwardly with respect to said inner elongated member to accommodate the user moving away from said fixed lower body exercise platform while the user is grasping the upper end of said elongated upper body exercising unit and moving said upper body exercising unit against said yielding resistance about said center in conjunction with the user stepping off of said step-receiving surface of said fixed lower body exercise platform, and said outer hollow elongated member moving axially downwardly with respect to said inner elongated member to accommodate the user moving toward said fixed lower body exercise platform while the user is grasping the upper end of said elongated upper body exercising unit and moving said elongated upper body exercising unit against said yielding resistance about said center in conjunction with the user stepping onto said step-receiving surface of said fixed lower body exercise platform, (2) define said variable volume air chamber within said gap defined between said outer surface of said inner elongated member and said inner surface of said outer hollow elongated member, the volume of said variable volume air chamber expanding when said outer hollow elongated member is moved by the user axially downwardly with respect to said inner elongated member and the volume of said variable volume air chamber contracting when said outer hollow elongated member is moved by the user axially upwardly with respect to said inner elongated member, and (3) define said restricted air passage between a portion of said elongated member coupling structure and a one of said outer hollow elongated member and said inner elongated member, said restricted air passage being constructed and arranged to restrict air flow into said variable volume air chamber when the volume of said variable volume air chamber is expanding to effect a resistance to downward axial movement of said outer hollow elongated member with respect to said inner elongated member to enhance an exercising effect of downward axial movement of said outer hollow elongated member with respect to said inner elongated member by the user, and to restrict air flow out of said variable volume air chamber when the volume of said variable volume air chamber is contracting to effect a resistance to upward axial movement of said outer hollow elongated member with respect to said inner elongated member to enhance an exercising effect of upward axial movement of said outer hollow elongated member with respect to said inner elongated member by the user.

8. The exercising apparatus of claim 7 wherein said elongated member coupling structure comprises:

a guide plug fixed to said inner elongated member proximate an upper end thereof, said guide plug being sized to enable said outer hollow elongated member to fit over said guide plug, to maintain said outer hollow elongated member in a substantially coaxial orientation with respect to said inner elongated member when said outer hollow elongated member is moved axially with respect to said inner elongated member, and to define said restricted air passage between an outer periphery of said guide plug and the inner surface of said outer hollow elongated member; and a bushing slidably disposed about an outer periphery of said inner elongated member and fixed to an inner periphery of a lower end of said outer hollow elongated member, said bushing being disposed on said inner elongated member in a spaced-apart relation with respect to said guide plug when said outer hollow elongated member is in a lowest axial position with respect to said inner elongated member, said variable volume air chamber being defined within said gap between said bushing and said guide plug, the volume of said variable volume air chamber decreasing when said bushing approaches said guide plug as said outer hollow elongated member is moved axially upwardly with respect to said inner elongated member, and the volume of said variable volume air chamber increasing when said bushing moves away from said guide plug as said outer hollow elongated member is moved axially downwardly with respect to said inner elongated member.

9. The upper body exercising apparatus of claim 7 wherein said inner elongated member comprises an aluminum tube and said outer elongated member comprises a tube formed from polyvinylchloride.

10. The exercising apparatus of claim 4 wherein each of said pair of mounting structures includes a coil spring constructed and arranged to secure said lower end of an associated elongated upper body exercising unit to said base structure and to provide said yielding resistance to said movement of said associated elongated upper body exercising unit in any direction about said center.

11. The adjustable exercising apparatus of claim 4 wherein each of said adjusting mechanisms comprises:

a swivel mount, fixed to said base structure;

a threaded lug extending vertically upwardly from said swivel mount;

a cylindrical swivel guide having an aperture defined axially therethrough, said cylindrical swivel guide being dispose on said swivel mount with said threaded lug extending through said axial aperture to enable rotation of said cylindrical swivel guide about said threaded lug;

a pivoting arm extending radially outwardly from said cylindrical swivel guide and pivoting about said threaded lug when said cylindrical swivel guide is rotated about said threaded lug;

a pole attachment member fixed proximate an end of said pivoting arm opposite said cylindrical swivel guide constructed and arranged for attachment of said lower end of an associated elongated upper body exercising unit thereto, said center of said associated elongated upper body exercising unit being pivotable about said threaded lug with said pivoting arm and said pole attachment member; and an adjusting knob disposed atop said cylindrical swivel guide, said adjusting knob having a bore defined therein with interior threads for receiving an end portion of said threaded lug extending beyond said axial aperture defined in said cylindrical swivel guide, when said adjusting knob is tightened onto said end portion of said threaded lug, said cylindrical swivel guide is compressed between said adjusting knob and said swivel mount to prevent rotation of said cylindrical swivel guide about said threaded lug to fix said center of said associated elongated upper body exercising unit attached to said pole attachment member in a selected lateral orientation with respect to said base structure.

12. An exercising apparatus comprising:

a base structure comprising a fixed lower body exercise platform constructed and arranged to permit a user to perform lower body exercises by stepping onto and off of said fixed lower body exercise platform in any of a plurality of different directions with respect to said fixed lower body exercise platform;

a pair of elongated upper body exercising units having upper ends constructed and arranged to be grasped by opposite hands of the user; and a pair of mounting structures constructed and arranged to mount lower ends of said pair of elongated upper body exercising units on said base structure, said mounting structures including laterally yielding members constructed and arranged to enable said upper ends of said pair of elongated upper body exercising units to be moved by the user grasping the upper ends of said pair of elongated upper body exercising units and moving said pair of elongated upper body exercise units in any direction about centers generally coincident with respective lower ends of said pair of elongated upper body exercising unit; and to accommodate movement of the user in different directions with respect to said fixed lower body exercise platform, said laterally yielding members being further constructed and arranged to provide a yielding resistance to said movement by the user of said pair of elongated upper body exercising units in any direction about said centers, said mounting structure being constructed and arranged to enable the user to move one or both of said elongated upper body exercising units against the yielding resistance in conjunction with the user stepping onto or off of said step-receiving surface of said fixed lower body exercise platform or while the user is standing on said fixed lower body exercise platform, each of said elongated upper body exercising units comprising:

a fixed inner elongated member operatively coupled at a lower end thereof with said base structure to enable said upper end of said elongated upper body exercising unit to be moved by the user grasping the upper end of said elongated upper body exercising unit and moving said elongated upper body exercising unit against the yielding resistance in any direction about said center to accommodate movement of the user in different directions with respect to said fixed lower body exercise platform;

a telescoping outer elongated member oriented substantially coaxially over said fixed inner elongated member and defining a gap between an outer surface of said fixed inner elongated member and an inner surface of said telescoping outer elongated member; and elongated member coupling structure constructed and arranged to:

(1) couple said fixed inner elongated member to said telescoping outer elongated member to enable limited telescoping axial movement of said telescoping outer elongated member with respect to said fixed inner elongated member, said telescoping outer elongated member moving axially upwardly with respect to said fixed inner elongated member to accommodate the user moving away from said fixed lower body exercise platform while the user is grasping the upper end of said elongated upper body exercising unit and moving said upper body exercising unit against the yielding resistance about said center in conjunction with the user stepping off of said fixed lower body exercise platform, and said outer elongated member moving axially downwardly with respect to said inner elongated member to accommodate the user moving toward said fixed lower body exercise platform while the user is grasping the upper end of said elongated upper body exercising unit and moving said elongated upper body exercising unit against the yielding resistance about said center in conjunction with the user stepping onto said fixed lower body exercise platform, (2) define a variable volume air chamber within said gap defined between said outer surface of said fixed inner elongated member and said inner surface of said telescoping outer elongated member, the volume of said variable volume air chamber expanding when said telescoping outer elongated member is moved by the user axially downwardly with respect to said fixed inner elongated member and the volume of said variable volume air chamber contracting when said telescoping outer elongated member is moved by the user axially upwardly with respect to said fixed inner elongated member, and (3) define a restricted air passage between a portion of said elongated member coupling structure and the inner surface of said telescoping outer elongated member, said restricted air passage being constructed and arranged to restrict air flow into said variable volume air chamber when the volume of said variable volume air chamber is expanding to effect a resistance to downward axial movement of said telescoping outer elongated member with respect to said fixed inner elongated member to enhance an exercising effect of downward axial movement of said telescoping outer elongated member with respect to said fixed inner elongated member by the user, and to restrict air flow out of said variable volume air chamber when the volume of said variable volume air chamber is contracting to effect a resistance to upward axial movement of said telescoping outer elongated member with respect to said fixed inner elongated member to enhance an exercising effect of upward axial movement of said telescoping outer elongated member with respect to said fixed inner elongated member by the user, said elongated member coupling structure comprising:

a guide plug fixed to said fixed inner elongated member proximate an upper end thereof, said guide plug being sized to enable said telescoping outer elongated member to fit over said guide plug, to maintain said telescoping outer elongated member in said substantially coaxial orientation with respect to said fixed inner elongated member when said telescoping outer elongated member is moved axially with respect to said fixed inner elongated member, and to define said restricted air passage between an outer periphery of said guide plug and the inner surface of said telescoping outer elongated member; and a bushing slidably disposed about an outer periphery of said fixed inner elongated member and fixed to an inner periphery of a lower end of said telescoping outer elongated member, said bushing being disposed on said fixed inner elongated member in a spaced-apart relation with respect to said guide plug when said telescoping outer elongated member is in a lowest axial position with respect to said fixed inner elongated member, said variable volume air chamber being defined within said gap between said bushing and said guide plug, the volume of said variable volume air chamber decreasing when said bushing approaches said guide plug as said telescoping outer elongated member is moved axially upwardly with respect to said fixed inner elongated member, and the volume of said variable volume air chamber increasing when said bushing moves away from said guide plug as said telescoping outer elongated member is moved axially downwardly with respect to said fixed inner elongated member.

13. The upper body exercising apparatus of claim 12 wherein said fixed inner elongated member comprises an aluminum tube and said telescoping outer elongated member comprises a tube formed from polyvinylchoride.

* * * * *